US011454383B2

(12) United States Patent
Gerlings

(10) Patent No.: US 11,454,383 B2
(45) Date of Patent: Sep. 27, 2022

(54) WIRELESS MODULAR LIGHT SYSTEM

(71) Applicant: Phillip Gerlings, Gilbert, AZ (US)

(72) Inventor: Phillip Gerlings, Gilbert, AZ (US)

( * ) Notice: Subject to any disclaimer, the term of this patent is extended or adjusted under 35 U.S.C. 154(b) by 0 days.

(21) Appl. No.: 17/167,859

(22) Filed: Feb. 4, 2021

(65) Prior Publication Data

US 2021/0239308 A1 Aug. 5, 2021

Related U.S. Application Data

(60) Provisional application No. 62/970,294, filed on Feb. 5, 2020.

(51) Int. Cl.

| | |
|---|---|
| ***F21V 23/04*** | (2006.01) |
| ***F21L 4/00*** | (2006.01) |
| ***F21V 23/00*** | (2015.01) |
| ***F41G 1/35*** | (2006.01) |
| ***F21Y 115/10*** | (2016.01) |
| ***F21V 17/12*** | (2006.01) |

(52) U.S. Cl.

CPC ..... *F21V 23/0435* (2013.01); *F21L 4/005* (2013.01); *F21V 17/12* (2013.01); *F21V 23/009* (2013.01); *F21Y 2115/10* (2016.08); *F41G 1/35* (2013.01)

(58) Field of Classification Search

CPC ..... F21L 4/022

See application file for complete search history.

(56) References Cited

U.S. PATENT DOCUMENTS

| | | | | |
|---|---|---|---|---|
| 7,220,013 | B2 * | 5/2007 | Sharrah | H01M 50/213 429/170 |
| 7,281,815 | B1 * | 10/2007 | Gustafson | F21V 23/0421 362/206 |
| 9,638,404 | B2 * | 5/2017 | Lee | F21V 23/0414 |
| 10,184,756 | B1 * | 1/2019 | McCauley | F41G 1/35 |
| 10,267,501 | B1 * | 4/2019 | Lowchareonkul | F21V 23/04 |
| 2004/0198336 | A1 * | 10/2004 | Jancic | F41G 1/35 455/420 |
| 2007/0171082 | A1 * | 7/2007 | Melnik | F21L 4/005 340/574 |
| 2012/0020063 | A1 * | 1/2012 | Mironichev | H05B 47/19 362/191 |
| 2017/0311402 | A1 * | 10/2017 | Qiu | H05B 45/10 |
| 2019/0098731 | A1 * | 3/2019 | Man | H05B 47/16 |

* cited by examiner

*Primary Examiner* — Eric T Eide

(57) ABSTRACT

A remote control for operating a light system having a light source housed in a light housing, a power source, and a manual switch that can selectively activate a light source comprising a tail cap configured to couple to the light source, wherein the tail cap has a housing that houses a microcontroller and a wireless communication module, wherein the microcontroller can be coupled to the wireless communication module and to the light source such that the microcontroller can operate to selectively control the light source when the tail cap is coupled to the light source. A remote having a communication interface wherein the communication interface can communicate with the wireless communication module wherein the communication interface receives user preference information from the remote to allow the user to remotely control the light source.

20 Claims, 15 Drawing Sheets

WIRELESS MODULAR LIGHT SYSTEM

CROSS REFERENCE TO RELATED APPLICATIONS

The present application claims the benefit under 35 U.S.C. 119 of U.S. Provisional patent Application Ser. No. 62/970,294 filed Feb. 5, 2020. The U.S. Provisional Patent Application Ser. No. 62/970,294 is hereby incorporated by reference in its entirety.

TECHNICAL FIELD

The present invention relates to the portable light and more particularly relates to a wireless light system that can be adapted to any type of flashlight which can be mounted and controlled remotely.

BACKGROUND OF THE INVENTION

The conventional lighting system for a firearm, vehicle or helmet, or other base includes a light source that connects to the base, typically through a mounting system. The light source can be manually mounted to aid a user in obtaining the best lighting conditions. It has been the practice to use LEDs or incandescent light bulbs, suitably encased in a light body. Such light sources are often commonly employed by firearm owners, vehicle owners, helmet owners and others who require a concentration of light while frequently changing locations or requiring light at specific locations. In addition, current light sources have a body with a push button switch located somewhere on the body and the light source on one end of the body with a battery connected to the light source through the switch.

Some lighting systems have incorporated a remote to remotely control the light from a distance. Current remote lighting systems require long cables extending from the body to the location where a push button remote can turn on or off the light. This is problematic because the cable can get in the way and cause issues for the user who has their light source attached to their gun, handlebars, or helmet. Other remote lighting systems require the user to purchase a light that has the remote built into the light but requires the light to be on for the light to work with the remote, and the remote can only turn the light on or off with no additional features. In addition, the remote lighting systems can only work with the light system that it came with or is attached to and cannot be adapted to or connected to another base or work in conjunction with another remote lighting system.

It is desirable to provide a light source that can be remotely controlled by a user, and it is also desirable to be able to adjust the light source's intensity, strobe, or other affects remotely. Furthermore, it is desirable to allow a user to convert their current non-wireless light source to a wireless light source by changing a few components within the light source giving them adaptability and portability with the new remote lighting system.

Applicant believes that any material incorporated above is "non-essential" in accordance with 37 CFR 1.57, because it is referred to for purposes of indicating the background of the invention or illustrating the state of the art. However, if the Examiner believes that any of the above-incorporated material constitutes "essential material" within the meaning of 37 CFR 1.57(c)(1)-(3), applicant will amend the specification to expressly recite the essential material that is incorporated by reference as allowed by the applicable rules.

BRIEF SUMMARY OF THE INVENTION

A remote control for operating a light system can have a light source housed in a light housing, a power source, and a manual switch to selectively activate the light source. The remote control system can comprise a tail cap that can be configured to couple to the light source, wherein the tail cap or light head can have a housing that houses a microcontroller and a wireless communication module, wherein the microcontroller is coupled to the wireless communication module and to the light source such that the microcontroller can operate to selectively control the light source when the tail cap is coupled to the light source. A remote can have a communication interface wherein the communication interface communicates with the wireless communication module wherein the communication interface receives user preference information from the remote to allow the user to remotely control the light source.

The light housing can be coupled to a body that has a threaded end and the tail cap housing has a threaded portion corresponding to the threaded end of the body to attach to the threaded end of the body. The light housing can be coupled to a body wherein the tail cap can further comprise an adapter to attach the tail cap to the body. The source of light can be light emitting diodes. The body has a threaded end wherein the adapter has a threaded portion corresponding to the threaded end of the body to attach the threaded end of the body. The remote can be a handheld device. The tail cap can be configured to be used with one of a plurality of adapters, wherein each of the plurality of adapters is sized to correspond to a differently sized body. The remote can further comprise a switch with at least one button. The remote can be configured to transmit the user's desired light information. The remote can be programmable and configurable via a portable computing device. The tail cap further comprises a replacement switch that operates in place of the manual switch when the tail cap is coupled to the light source.

A wireless light system can comprise a light housing that houses a source of light, a body coupled to the light housing, a tail cap comprising microcontroller coupled to a wireless communication module, a remote having a communication interface wherein the communication interface wirelessly communicates user selected light information from the remote to the microcontroller to allow the user to remotely operate the light source. The light housing is coupled to a body, and wherein the tail cap is also coupled to the body and further comprises a power source, and a switch. The source of light is light emitting diodes. The remote can be a handheld computing device. The remote can be a switch with at least one button. The remote can be programmable and configurable via a portable computing device.

In some embodiments, an accessory for a light system having a light source housed in a light housing, a power source, and a manual switch to selectively activate the light source is provided having a tail cap that can be detachably coupled to the light housing of the light system. A microcontroller can determine the type of light system by identifying the type of the light source of the light system, the power source type of the light system, the current needed for the light of the light system, or a discharge rate of the power source of the light system.

The microcontroller can adjust its settings to match the type of flashlight to which the accessory is attached and send information to a user's remote to allow the user to better operate the light system through the accessory. The setting that can be adjusted include the type of flashlight of the light system, the current needed to power the light system, the type of power source for the light system, or the estimated time to recommended discharge of the light system.

Aspects and applications of the invention presented here are described below in the drawings and detailed description of the invention. Unless specifically noted, it is intended that the words and phrases in the specification and the claims be given their plain, ordinary, and accustomed meaning to those of ordinary skill in the applicable arts. The inventors are fully aware that they can be their own lexicographers if desired. The inventors expressly elect, as their own lexicographers, to use only the plain and ordinary meaning of terms in the specification and claims unless they clearly state otherwise and then further, expressly set forth the "special" definition of that term and explain how it differs from the plain and ordinary meaning. Absent such clear statements of intent to apply a "special" definition, it is the inventors' intent and desire that the simple, plain and ordinary meaning to the terms be applied to the interpretation of the specification and claims.

The inventors are also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventors are fully informed of the standards and application of the special provisions of 35 U.S.C. § 112 (f). Thus, the use of the words "function," "means" or "step" in the Detailed Description or Description of the Drawings or claims is not intended to somehow indicate a desire to invoke the special provisions of 35 U.S.C. § 112 (f), to define the invention. To the contrary, if the provisions of 35 U.S.C. § 112 (f) are sought to be invoked to define the inventions, the claims will specifically and expressly state the exact phrases "means for" or "step for, and will also recite the word "function" (i.e., will state "means for performing the function of [insert function]"), without also reciting in such phrases any structure, material or act in support of the function. Thus, even when the claims recite a "means for performing the function of . . . " or "step for performing the function of . . . ," if the claims also recite any structure, material or acts in support of that means or step, or that perform the recited function, then it is the clear intention of the inventors not to invoke the provisions of 35 U.S.C. § 112 (f). Moreover, even if the provisions of 35 U.S.C. § 112 (f) are invoked to define the claimed inventions, it is intended that the inventions not be limited only to the specific structure, material or acts that are described in the preferred embodiments, but in addition, include any and all structures, materials or acts that perform the claimed function as described in alternative embodiments or forms of the invention, or that are well known present or later-developed, equivalent structures, material or acts for performing the claimed function.

BRIEF DESCRIPTION OF THE DRAWINGS

A more complete understanding of the present invention may be derived by referring to the detailed description when considered in connection with the following illustrative figures. In the figures, like reference numbers refer to like elements or acts throughout the figures.

Elements and acts in the figures are illustrated for simplicity and have not necessarily been rendered according to any particular sequence or embodiment.

DETAILED DESCRIPTION OF THE INVENTION

In the following description, and for the purposes of explanation, numerous specific details are set forth in order to provide a thorough understanding of the various aspects of the invention. It will be understood, however, by those skilled in the relevant arts, that the present invention may be practiced without these specific details. In other instances, known structures and devices are shown or discussed more generally in order to avoid obscuring the invention. In many cases, a description of the operation is sufficient to enable one to implement the various forms of the invention, particularly when the operation is to be implemented in software. It should be noted that there are many different and alternative configurations, devices and technologies to which the disclosed inventions may be applied. The full scope of the inventions is not limited to the examples that are described below.

Figure 2:
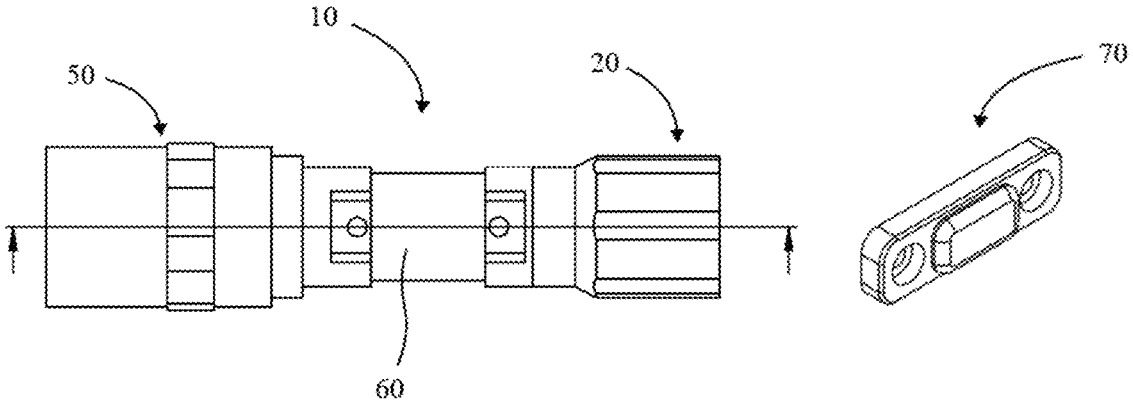
FIG. 2 is a top view of wireless light system omitting the remote in accordance to one, or more embodiments.
Figure 3:
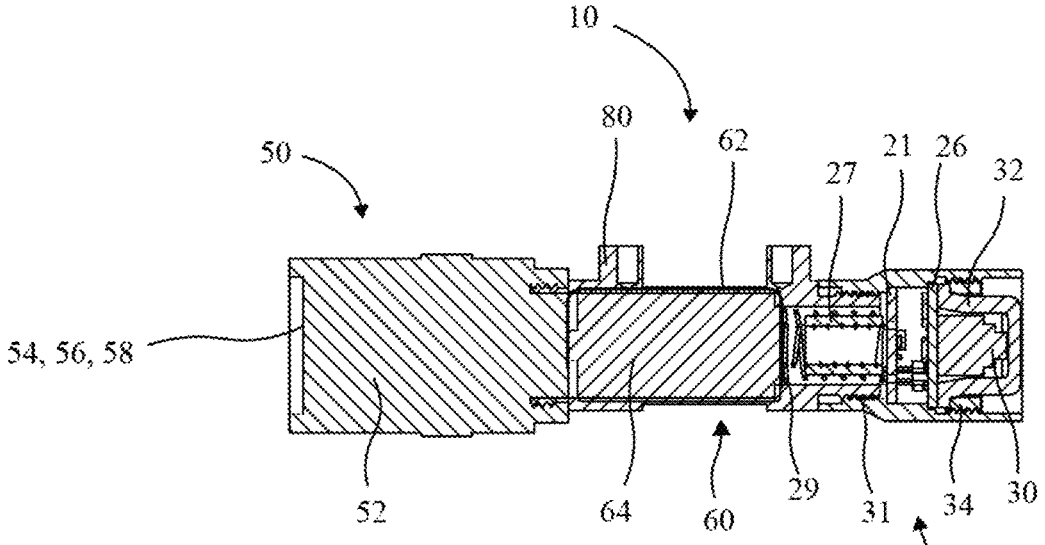
FIG. 3 is a cross-sectional view of wireless light system omitting the remote in accordance to one, or more embodiments.

Referring initially to FIGS. 2 and 3, a remote control for operating a light system shown generally at 10 having a light source 50 housed in a light housing 52, a power source 64, and a manual switch 30 to selectively activate the light source 54. In one embodiment, the manual switch 30 is a part of a tail cap 20 having a tail cap housing 22, and a body 60. A remote 70 is also provided to selectively activate the light source 54.

Referring to FIG. 3 through 6, the tail cap 20 can comprise a processor 26 wherein the processor can comprise a wireless communication module 28 as described below. The processor 26 can be connected to an antenna 21 wherein the antenna can be a trace antenna, loop, inverted, meandered, circular, chip antenna or the like. The antenna 21 can communicate between the remote 70 and the processor 26 and/or the wireless communication module 28. In another embodiment, the light source 50 can comprise the processor 26 and the antenna 21.

The light source 50 can further comprise a light 54, a reflector 58, and a lens 56 wherein the light housing 52 can be connected to the body 60 of the tail cap 20. The body 60 has a compartment 62 housing a power source 64. The light housing 50 can be removably attached to the compartment 62 by a male and female thread which can be machined, molded, or cast within light housing and the compartment or in other embodiments the light housing can be attached to the compartment by any other fastening device known by those skilled in the art, such as slots and clips, bolts, screws, rivets, press fit or the like. In the preferred embodiment the remote control for operating a light system 10 can omit the light housing 50, and the body 60 wherein the tail cap 20 can be sized accordingly to fit into any type of body creating a wireless system for any type of light. The body 60 can be used to conduct the positive or negative voltage to the light 54. In certain embodiments the body 60 can be a molded non-conductive or polymer material with a wire overmold for conducting the positive and negative voltage from the power source 64 to the light 54.

The compartment 62 can vary in size and shape to provide a suitable grip or suitable attachment point for a mount 80 (as shown in FIG. 3) that can allow the remote control for operating a light system 10 to attach to a firearm, a helmet, a vehicle, a utility mount (Loc-line, ball/socket), a utility vehicle, or the like. The compartment 62 can hold at least one power source 64 which can be any suitable technology such as alkaline dry cells, LiON coil cell, or rechargeable cells that in some embodiments can operate for example, between 0 volts and 10 volts, more preferably between 2 volts and 8 volts, and still more preferably between 2.6 and 6.3 volts, or the like.

The power source 64 can have a positive/negative terminal on one side, or a positive positive/negative terminal on one side or positive terminal on both sides, or negative terminal on one side, negative positive/negative terminal with negative terminal on both sides, positive on one side. Alternatively, other portable DC electrical power sources such as solar cells or other power sources can be used as desired in place of the power source 64. The power source 64 can be rechargeable through induction or a recharging port, or the power source can be replaceable. The power source 64 can be encapsulated and can be removable from the compartment 62 wherein the compartment 62 can hold the power source 64 in place so that there is a constant connection between the power source 64, light 54, and an inner spring 24 or outer spring 29 within the tail cap housing 22. In certain embodiments, the antenna 21 and processor 26 can be between the power source 64 and the light 54, lens 56, and reflector 58 wherein having the antenna physically between the power source and the light 54, lens 56, and reflector 58 allows for the use of common, smaller CR123A and other high output batteries.

The head 52 of the light housing 50 can vary in size to and shape to provide for a suitable reflector 58, light 54 and lens 56 for the user's application and the intensity of the light. The reflector 58, light 54 and lens 56 can be placed into the head 52 and sealed to create a watertight seal around the external components. The lens 56 can shape the light into for example, a flood or fixed beam, a spot or focused beam, an adjustable beam, or the like. The light 54 can be any suitable light source such as incandescent light, light-emitting diodes, high-intensity discharge lights, pressurized gas light, solar powered light, or the like. The light 54 can be coupled to the lens allowing for the beam from the light to be shaped or magnified by the reflector 58 and/or lens 56. The reflector 58 can be a flat plate reflector, spherical reflector, parabolic reflector or the like.

Figure 5:
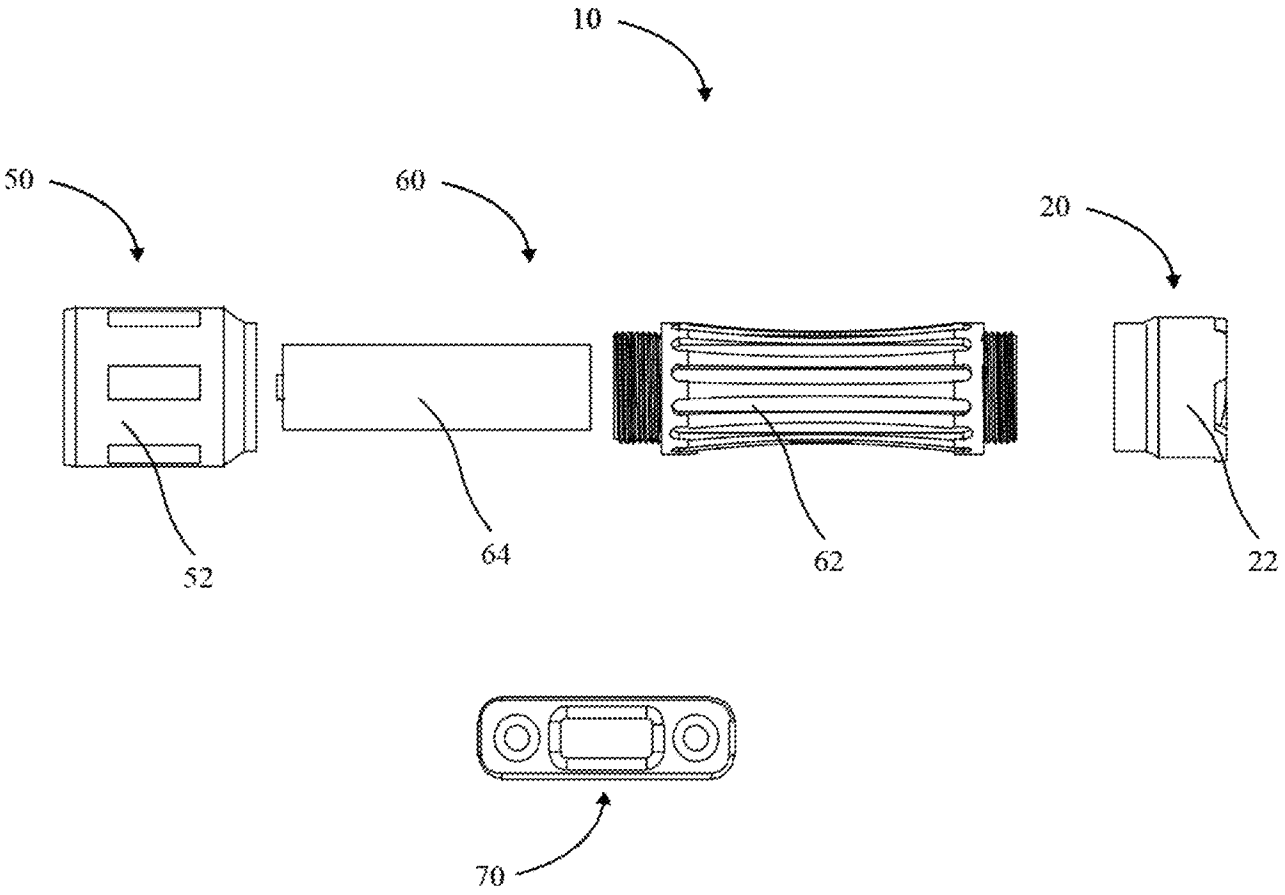
FIG. 5 is an exploded side view of wireless light system in accordance to one, or more embodiments.
Figure 6:
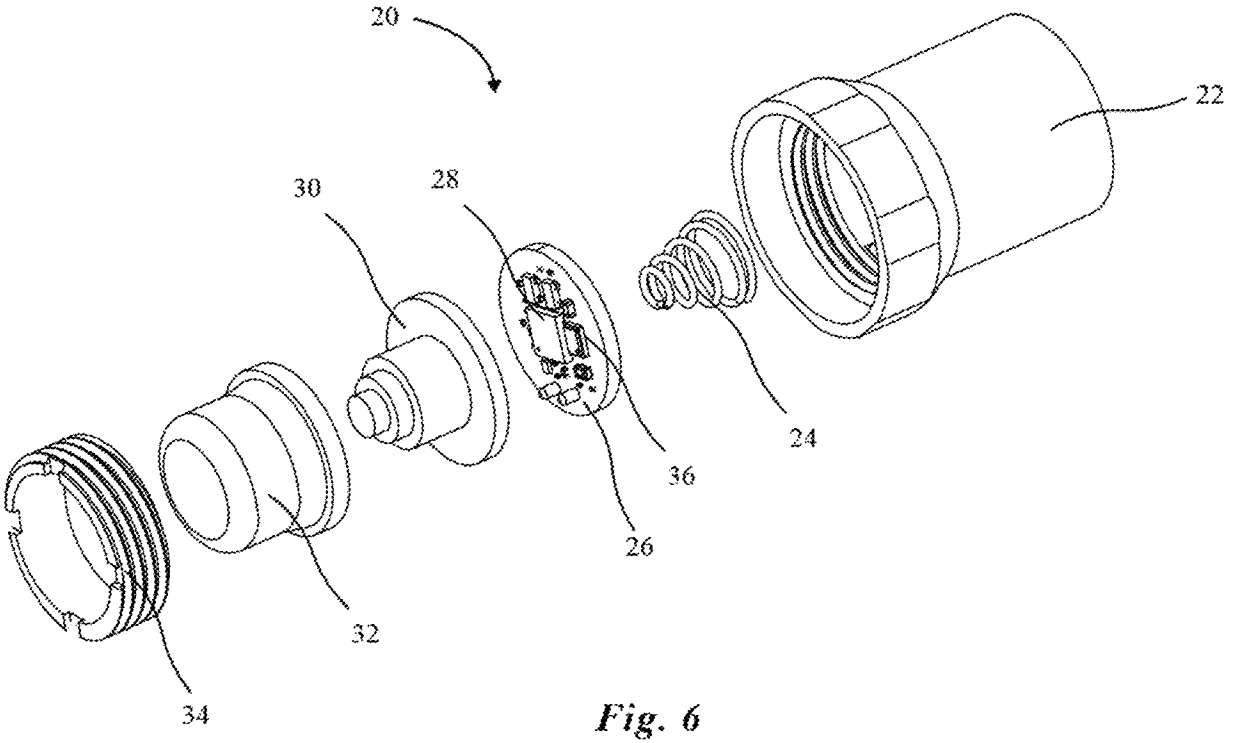
FIG. 6 is an isometric view of tail cap housing in accordance to one, or more embodiments.

Referring to FIGS. 7-10, the compartment 62 (as shown in FIG. 5) can further comprise a flex circuit 25. The flex circuit 25 can be adapted to fit any type or size of power source 64. The flex circuit 25 can be for example, one metal layer, double sided, multilayer and rigid flex circuits. The flex circuit 25 can be attached to an outer spring 29, or in other embodiments can be attached to an inner spring 24, or both. The tail cap 20 can further comprise a tail cap housing 22, an inner spring 24, an outer spring 29, a switch 30, and a protective cap 32 wherein the tail cap housing 22 can encapsulate the spring(s) 24, 29, switch 30, processor 26 and protective cap 32. The tail cap housing 22 can vary in size and shape to accommodate the varying sizes of the processor 26, switch 30, and protective cap 32. The inner spring 24, outer spring 29, processor 26, switch 30, and protective cap 32 can be locked into the tail cap housing 22 by a locking nut 34. The locking nut 34 can be such as, internal and external threads such as, for example, a locking nut 34 with thread on its outer diameter, and the tail cap housing with internal threads so that the locking nut can be screwed down onto the protective cap 32, switch 30, processor 26, and spring 24. In other embodiments, the locking nut 34 can be a snap ring, a retainer ring, self-locking ring, or the like. In another embodiment, the light housing 50 can comprise, an inner spring 24, an outer spring 29, wherein the light housing can encapsulate the spring(s) 24, 29, processor 26 and antenna 21 allowing for the sending and receiving components to be located in the light housing instead of the tail cap 20.

Figure 1:
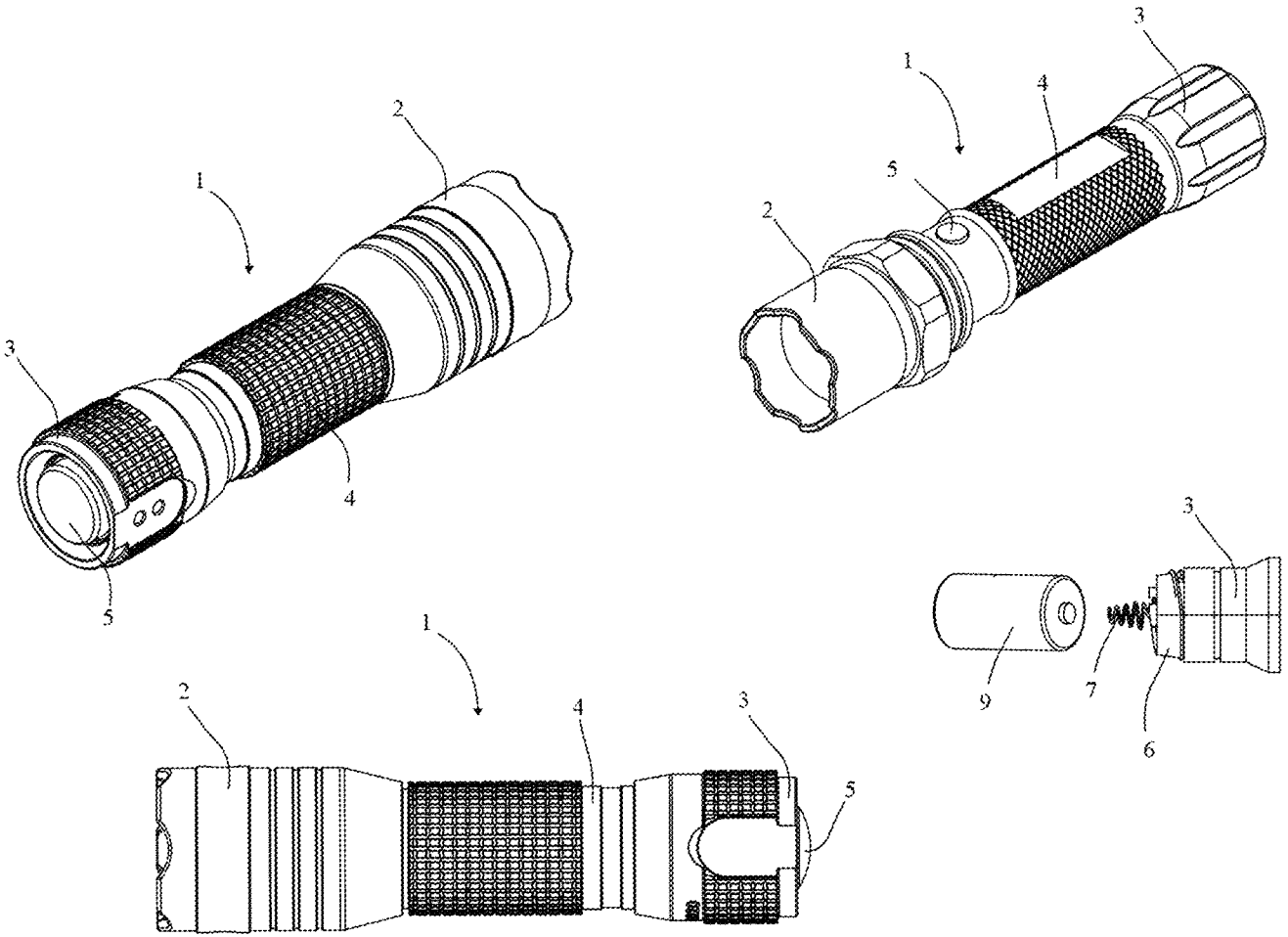
Fig. 1 (prior art)
FIG. 1 is a view of various common flashlights available in the prior art.

In a particular embodiment, the tail cap housing 22 is provided as a separate accessory that can be operated in conjunction with any other conventional flashlight. Referring to FIG. 1, common styles of popular flashlights 1 are shown. Each of these prior art flashlights 1 includes a light housing 2, and end cap 3, a body, 4 and a switch mechanism 5 that controls whether power is able to flow from the power source 9 to the light housing 2. The switch mechanism 5 can be housed in the end cap 2, on the body 4, or the light housing can be rotatably coupled to the body 4 such that rotating the light housing 2 relative to the body 4 activates or inactivates the switch mechanism 5. A common feature is that the end cap 2 is connected to the body 4 by a male thread 6 and female thread which can be machined, molded, cast, or the like within the end cap 2 and the body 4. The body 4 may be female threaded with the end cap 2 correspondingly male threaded as shown in FIG. 1 or the threading may be reversed.

Figure 4:
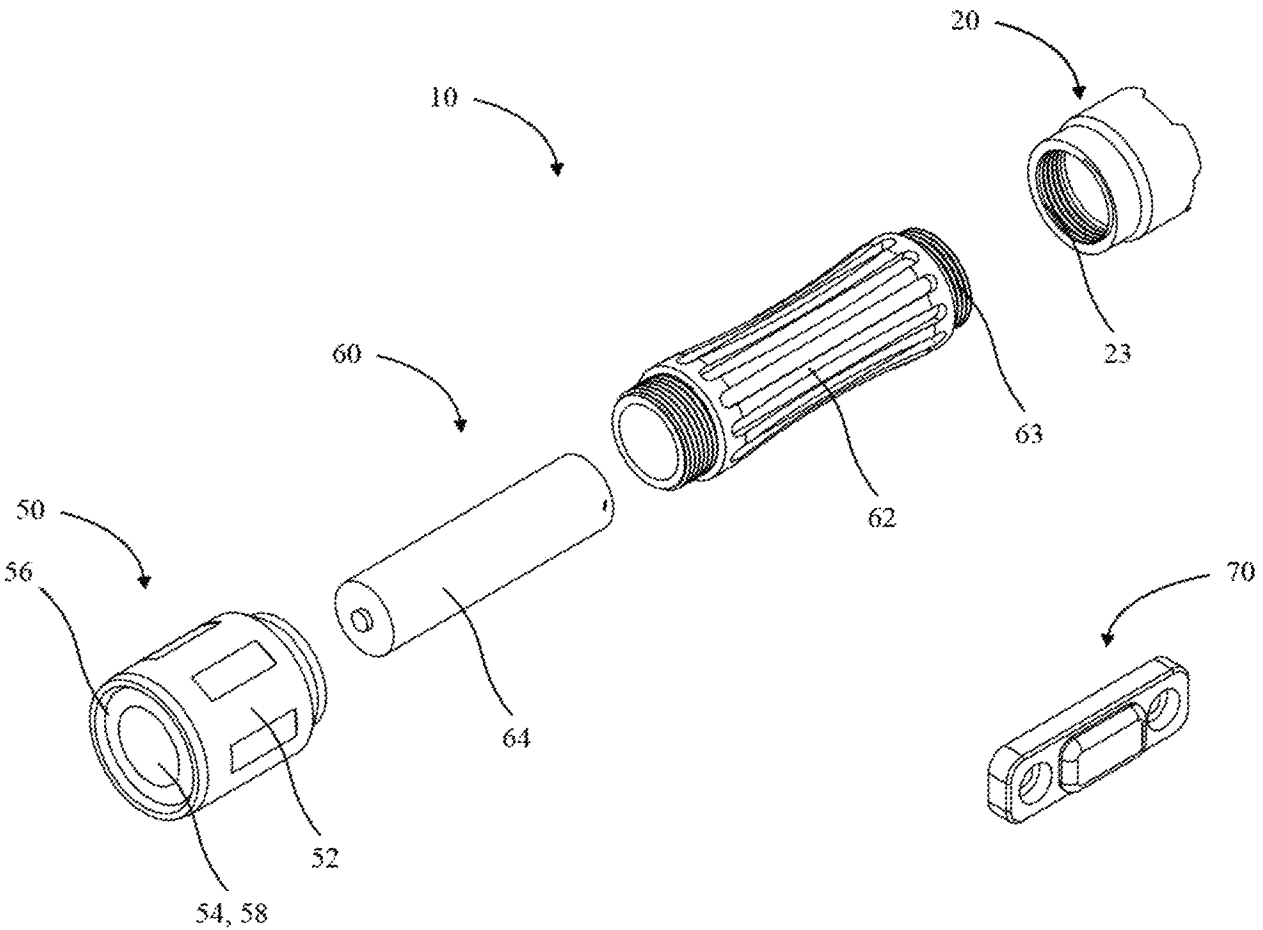
FIG. 4 is an exploded isometric view of wireless light system in accordance to one, or more embodiments.
Figure 7:
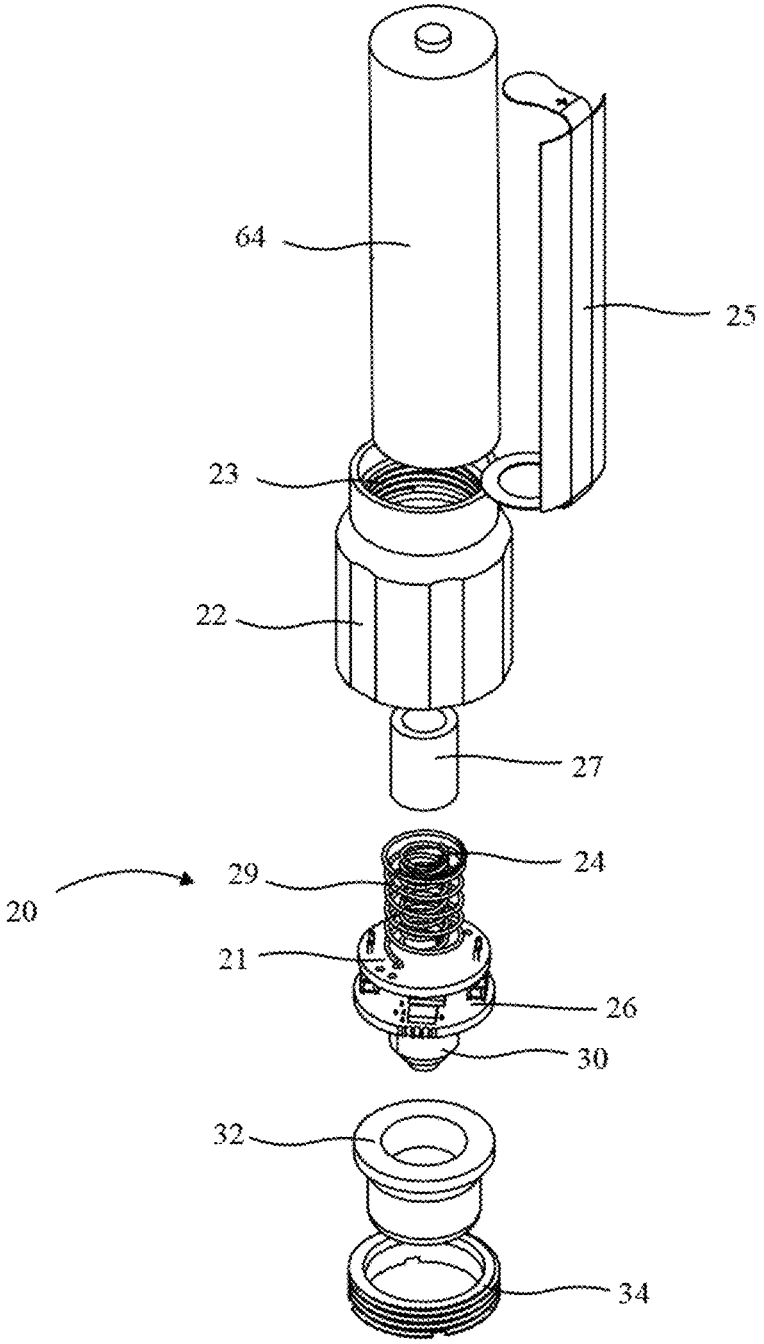
FIG. 7 is an isometric view of another embodiment of tail cap housing in accordance to one, or more embodiments.
Figure 8:
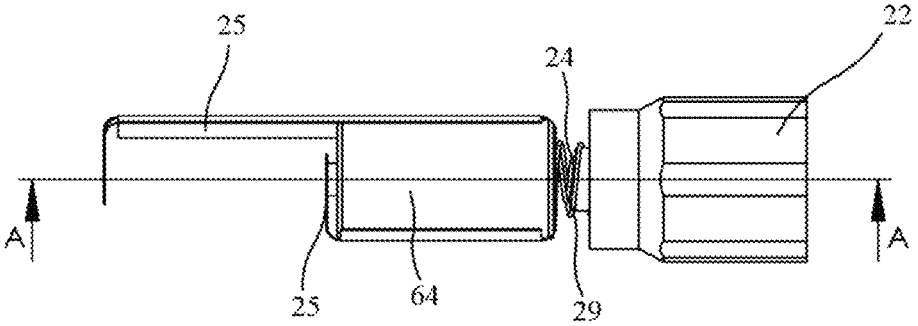
FIG. 8 is a side view of another embodiment of tail cap housing in accordance to one, or more embodiments.
Figure 9:
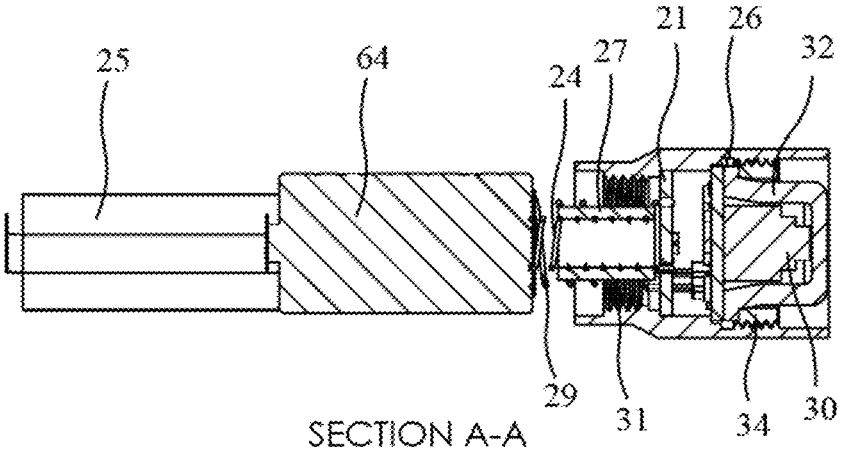
FIG. 9 is a cross-sectional view of another embodiment of tail cap housing in accordance to one, or more embodiments.
Figure 10:
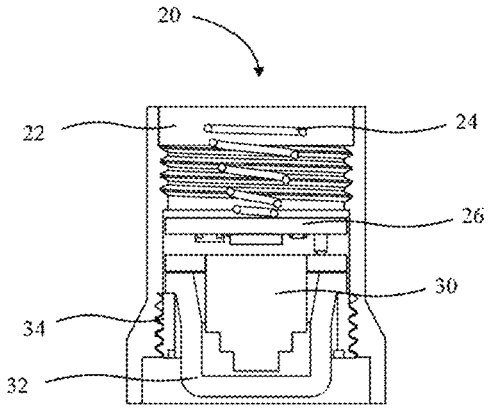
FIG. 10 is a cross-sectional view of yet another embodiment of tail cap housing in accordance to one, or more embodiments.

Referring to FIGS. 1 and 7, the tail cap 20 can be configured to replace the conventional end cap 2 on existing flashlight models 1. The tail cap housing 22 can include a threaded portion 23 that matches the threading of the body 4 of the particular prior art flashlight model 1. If the switch mechanism 5 of the prior art flashlight 1 is in the end cap 2, the switch 30 in the tail cap housing 22 will simply replace the switch mechanism 5 of the prior art flashlight 1. If the switch mechanism 5 is disposed elsewhere on the prior art flashlight 1, the switch mechanism 5 may be left in the activated position, and the processor 26 may still control whether power is able to flow from the power source 9 to the light housing 2. In some embodiments, the switch 30 can be manually operated to operate the prior art flashlight 1 when the microcontroller 36 is inoperable. The tail cap housing 22 can be connected to the compartment 62 by a male and female thread which can be machined, molded, cast, or the like within tail cap housing 22 and the compartment 62 or in other embodiments the tail cap housing 22 can be attached to the compartment 62 by a plurality of fasteners such as bolts, screws, rivets or the like (as shown in FIG. 4).

Referring to FIGS. 7 through 10, the inner spring 24 and/or outer spring 29 can be placed on the power source 64 which can complete the circuit allowing current to flow through the remote control for operating a light system 10 when the user activates or pushes the switch 30 on the wireless light system or remotely through the remote 70. The inner spring 24 and the outer spring 29 can be connected to the antenna 21 directly and the antenna can be connected to the processor 26, or it can go through the antenna's PCB and connect directly to the processor 26. The inner spring 24 and the outer spring 29 can be separated by a spring separator 27 wherein the spring separator 27 can keep the outer spring 29 from touching the inner spring 24. The spring separator 27 can be made from non-conductive material such as ceramic, plastic, rubber, porcelain, or any other non-conductive material suitable to keep the inner spring and outer spring separated. The inner spring 24 and outer spring 29 can be any suitable spring material such as a compression spring fixed on one end or two ends made out of a strip of metal such as brass, copper, nickel plated carbon steel, or the like which can complete the electrical connection between the power source 64, the light 54, the processor 26 and the switch 30. In certain embodiments the inner spring 24 or the outer spring 29 can be omitted.

The switch 30 can be placed between the protective cap 32 and the processor 26 wherein the switch 30 when manually operated by the user can power on or off the remote control 70 for operating a light system 10. The switch 30 can be, for example, a bezel twist switch, side click switch, tail cap switch, tail cap twist switch, membrane press switch, side slide switch, or the like. The protective cap 32 can allow for the switch 30 to be compressed or twisted without allowing water or other contaminates to enter the tail cap housing 22. The protective cap 32 can be such as, rubber, polymer, plastic, or the like. The protective cap 32 can have a protective seal, washer or O-ring that seals the protective cap 32 against the tail cap housing 22. The switch 30 can override or be overridden by the remote 70 in certain embodiments where the switch 30 can be programmed to change the settings on the light 54 by clicking or rotating the switch 30 to the user's desired settings.

The processor 26 can connect to a wireless communication module 28 wherein the wireless communication module 28 can turn on and off the light 54, vary the light intensity, or activate a strobe effect, and can be programed to the user's specific settings and needs. The processor 26 can have a microcontroller 36 employed to do any one of fetch data, decode the data and complete an assigned task. The microcontroller 36 can receive information from a remote 70 or a mobile processor via the communications module 28 which can control the light 54 and remotely change the light mode configurations such as intensity low/medium/high, strobe, SOS, ON/OFF, or the like. The processor 26 can be powered by its own power source such as a coin cell battery, lithium-ion battery, or the like, or it can be powered by the power source 64 when the tail cap 20 is connected to the body 60 and the power source 64.

The microcontroller 36 can additionally regulate the power source 64 and the amount of current being supplied to the light 54. In other embodiments the microcontroller 36 can unregulate the power source 64 such that the light will slowly diminish as the power source drains, or the microcontroller 36 does not regulate or unregulate the power source altogether. In some embodiments the user can choose through the remote 70 whether to regulate or unregulate the power source 64 extending the power source life or allowing the light 54 to stay on until the power source 64 is completely discharged to recommended levels. The microcontroller 36 can monitor the power source 64 and the light output to determine which setting is the best for power consumption allowing the power source 64 to dissipate at the optimal rate for the user's chosen settings. The microcontroller 36 can send updates to the remote 70 on the status of the system 10 which includes, but is not limited to, settings of the light 54, power source status, out of range status, time of life left, setting of the switch, connection status, or the like. The light 54 can be such as light emitting diodes, fluorescent, incandescent, or the light.

In certain embodiments, the processor 26 can have a separate power source (not shown) than the main power source 64 wherein the processor can send and receive data from the remote 70 to the antenna 21 and to the processor while the light is off and while there is not any power being supplied by the main power source. The separate power source (not shown) can be a battery, coin cell, solar cell wherein the separate power source can be between the antenna 21 and processor 26 or between the switch 30 and processor or any other suitable location.

In embodiments, the communication module 28 can be a Bluetooth (IEEE 802.15.1), Bluetooth low energy such as BLE 4.0 2.4 GHz, Wi-Fi, or the like. The communications module 28 and antenna 21 can send and receive data from the remote 70 from a distance up to at least 50 meters. The Industrial, Scientific and Medical ("ISM") frequency band can be any suitable frequency such as frequencies below 1 GHz. In the preferred embodiment the wireless frequencies can be at least 40 MHz to at least 4000 MHz. In other embodiments the ISM frequency band can be any frequency above 1 GHz. When pairing the remote 70 to the wireless communication module 28 the pairing can be digital encoded with a serial number identifier in a wireless message to ensure that there will not be any interference from other devices located next to the system 10.

The tail cap housing 22 can be adapted to allow any type of flashlight to convert into a wirelessly controlled flashlight. The tail cap 20 can be configured to be used with one of a plurality of adapters (not shown), wherein each of the plurality of adapters is sized to correspond to a differently sized body 62. The microcontroller 36 can determine the type of flashlight the tail cap 20 is attached to by identifying, for example, the power source type, and current needed for the light. The microcontroller 26 can adjust its settings to match the type of flashlight and send to a user's remote 70 such as, but not limited to, the type of flashlight, current needed to power the flashlight, the type of light, type of power source and estimated time to recommended discharge, or the like. The tail cap 20 can attach to, for example, headlamps, high intensity flashlights, tube flashlights, dive flashlights, tactical flashlights, shake flashlights or the like. In certain embodiments the tail cap 20 components such as the tail cap housing 22, the spring 24, the switch 30, the processor 26 and the protective cap 32 can be incorporated into a mount 80 (as shown in FIG. 19*b*). In other embodiments each tail cap 20 components can be omitted from the mount and left in the tail cap housing 22 allowing for a variety of configurations and sizes for the mount 80 and the tail cap 20. The mount 80 and the remote control for operating a light system 10 can have electrical contacts (not shown) wherein the wireless lighting system can receive the user's desired settings through the processor 26 wherein the mount can replace the tail cap of a conventional flashlight with the remote control converting the conventional flashlight to a wireless flashlight.

Figure 11:
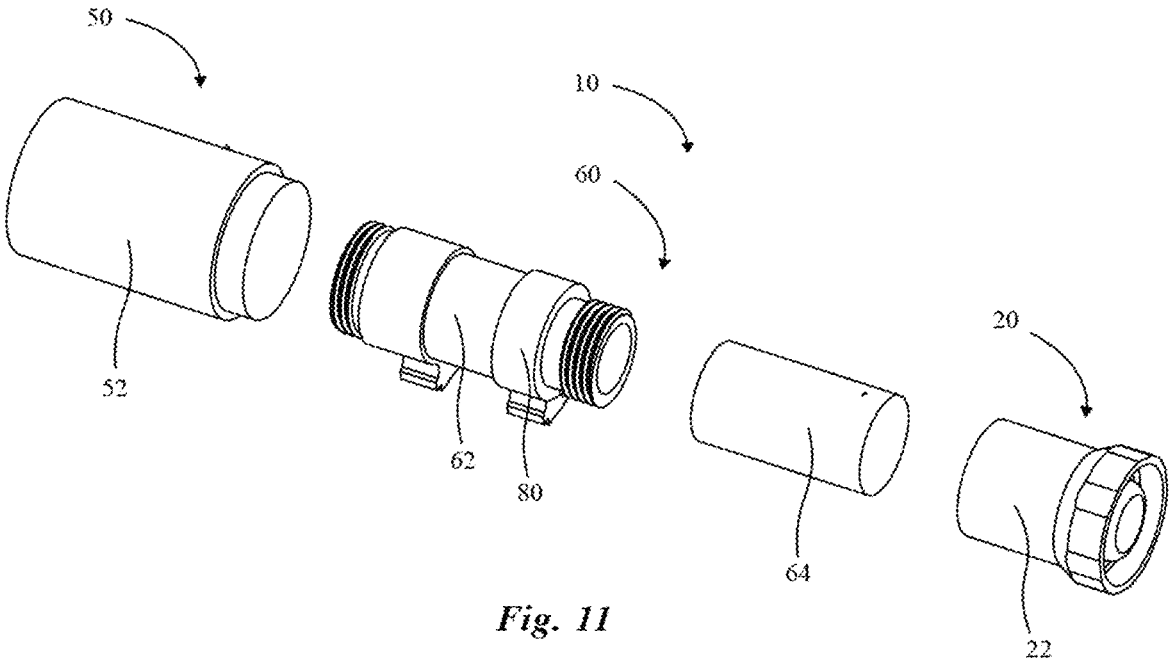
FIG. 11 shows another embodiment of a wireless light system in accordance to one, or more embodiments.

Referring to FIG. 11, another embodiment of the remote control for operating a light system 10 is shown, wherein the tail cap 20 can be adapted to fit the body 60 of any suitable size or shape and the body 60 can be attached to a mount 80 wherein the mount 80 can be adapted to fit handlebars, helmet, gun, all-terrain vehicle, or the like.

Figure 12:
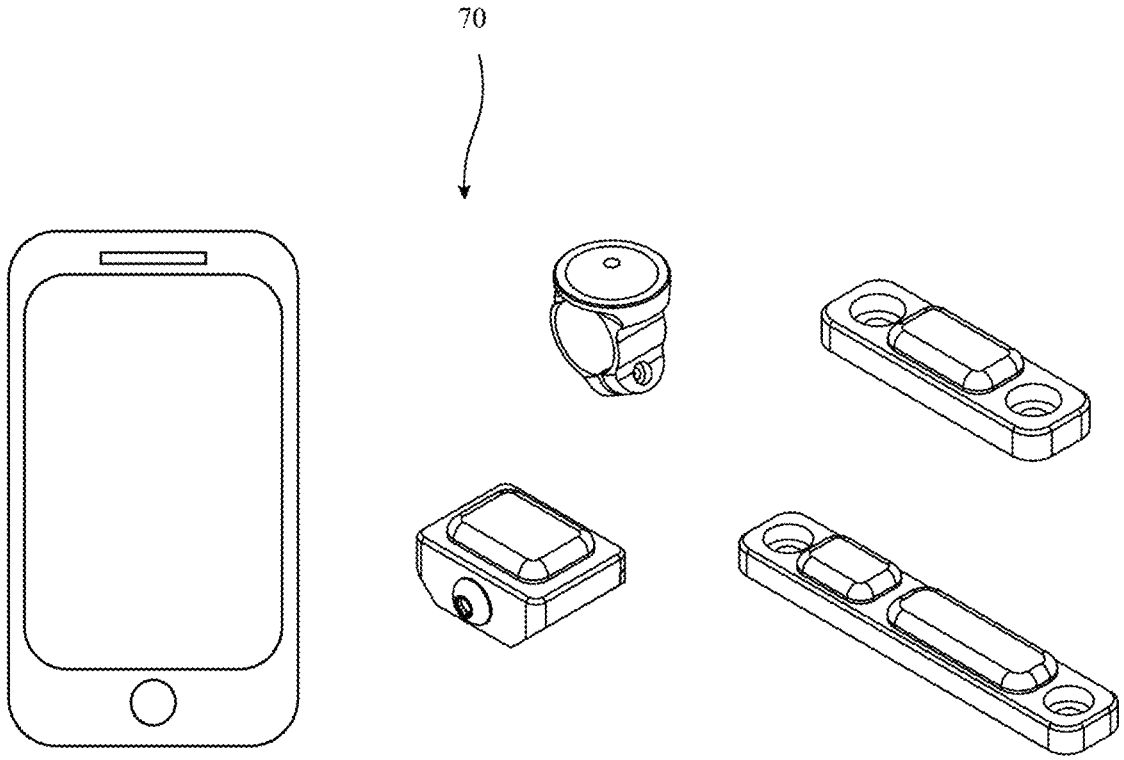
FIG. 12 shows examples of a remote of wireless light system in accordance to one, or more embodiments.
Figure 13:
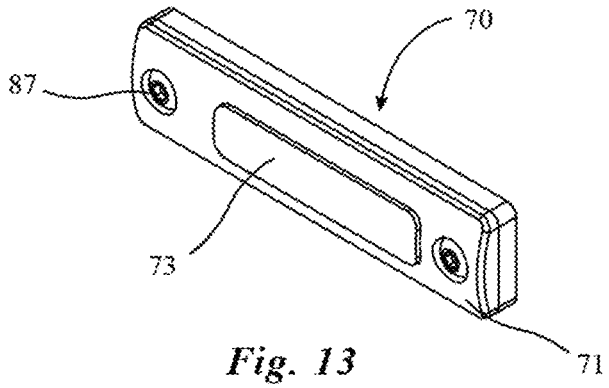
FIG. 13 shows an isometric view of remote for the wireless light system in accordance to one, or more embodiments.
Figure 14:
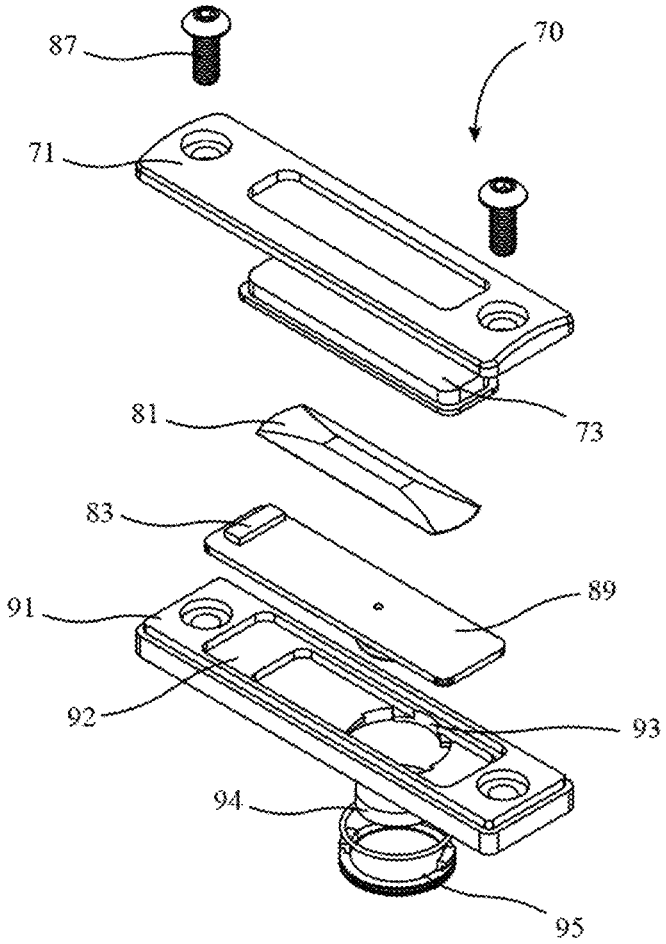
FIG. 14 shows an isometric exploded view of remote for the wireless light system in accordance to one, or more embodiments.
Figure 15:
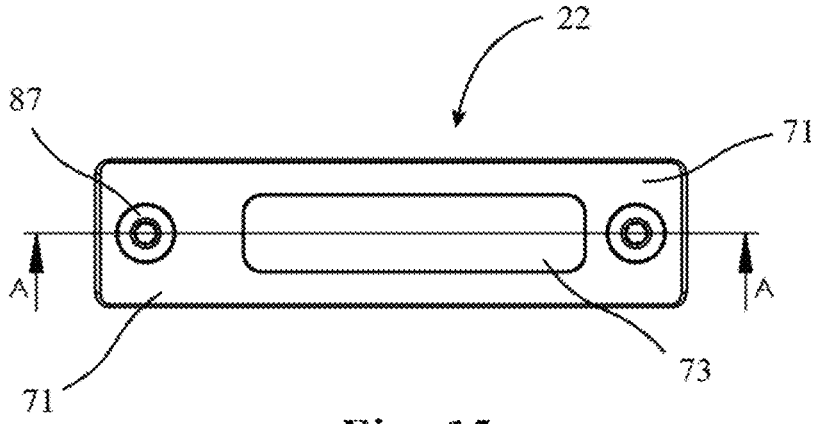
FIG. 15 shows a isometric exploded view of remote for the wireless light system in accordance to one, or more embodiments.
Figure 16:
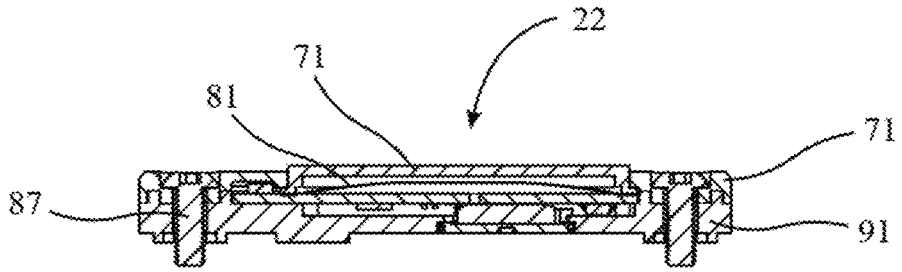
FIG. 16 shows a cross-sectional view of remote for the wireless light system in accordance to one, or more embodiments.

Referring to FIG. 12, examples are shown of the remote 70 of the remote control for operating a light system 10 wherein the remotes 70 can be any suitable remote that can wirelessly connect to and control a microcontroller 36 wherein the remote 70 can be such as, for example, a two button remote, a one button remote, a portable computing device, or the like that can wirelessly send the user's desired settings to the remote control 10.

Referring to FIGS. 13 through 16 the remote 70 can comprise a remote printed circuit board ("PCB") 89 having a remote antenna 83. The PCB 89 can have at least two connector pads (not shown) having a center pad and outside pad wherein when the remote conductive button 81 is pushed it can complete the circuit sending a signal to the communication interface 28 on the processor 26. The PCB can comprise a remote antenna 83 that can be such as a chip antenna, trace antenna, loop antenna, inverted antenna, meandered antenna, circular antenna, or the like. The remote can comprise a remote housing 91 wherein the remote housing can have a PCB cavity 92 wherein the PCB 89 can be placed into PCB cavity. The remote housing 91 can further comprise a power source cavity 93 wherein a remote power source 94 can be housed within the remote housing 91. The remote power source 94 can be a coin/button cell battery, zinc air cells, cylindrical battery, or the like. The remote power source 94 can be covered by a power source cap 95 wherein the power source cap is connected to the remote housing 91 by screwing it onto the housing or by one or more fasteners.

The remote 70 can further comprise a second protective cap 73 having the same or similar properties of the protective cap 32 shown in in FIG. 7. The second protective cap 73 can cover and protect the conductive button 81, and PCB 89. A remote cap 71 can be fastened to the remote housing 91 by at least one fastener wherein the remote cap can contain and surround partially the second protective cap 73, the conductive button 81 and the PCB 89. In certain embodiments, the remote 70 can be such as, for example, a push button remote, a portable processor such as a smartphone. The signal sent by the remote 70 to the microcontroller 36, via the wireless interface 28 can be a unique signal so that it only controls the wireless light system 10 to which it is connected wirelessly.

The remote 70 can be mounted on any remote base such as a weapon using an M-Lok, Picatinny, dovetail, or the like or it can be mounted on handlebars of a utility mount (Loc-line, ball/socket), bike, motorcycle, utility terrain vehicle, or the like. In certain embodiments, the remote 70 can control two or more wireless light systems 10 using a unique signal or a signal identifier.

Figure 17:
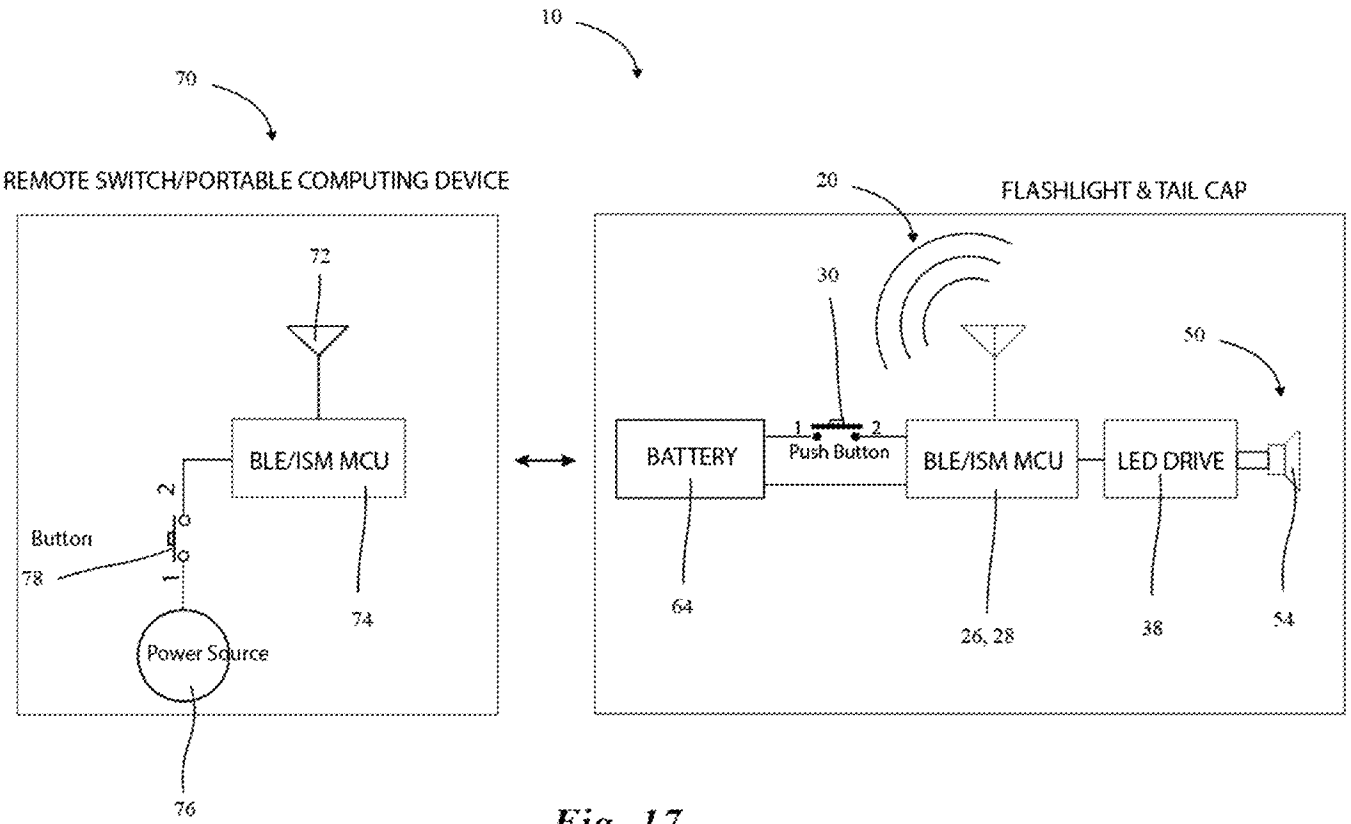
FIG. 17 is an electrical schematic of a wireless light system in accordance to one, or more embodiments.

Referring to FIG. 17, an example electrical schematic showing a wireless light system 10 is provided wherein the components have the same properties and function as previously stated. The remote 70 can further comprise at least one button 78 wherein the button can allow users to choose their settings and then send the chosen settings to the wireless light system 10 via a Bluetooth, Bluetooth Low Energy 72, Wi-Fi connection, or the like. The remote 70 can have a remote microcontroller 74 that can control the user's specified settings. In a remote 70 that is a handheld device 75 an application can allow the user to choose the settings of the wireless light system 10 through icons or buttons on the screen 77 of the handheld device 75, and all the information from the wireless light system 10 can be transmitted to the remote microcontroller 74 and displayed on the screen of the handheld device. The remote 70 can have its own power source 76. The remote 70 can control more than one wireless light systems 10 wherein the user can select between the wireless light systems connected to the remote 70 and choose different settings for each wireless light system or set the wireless light system each to the same setting.

Figure 18:
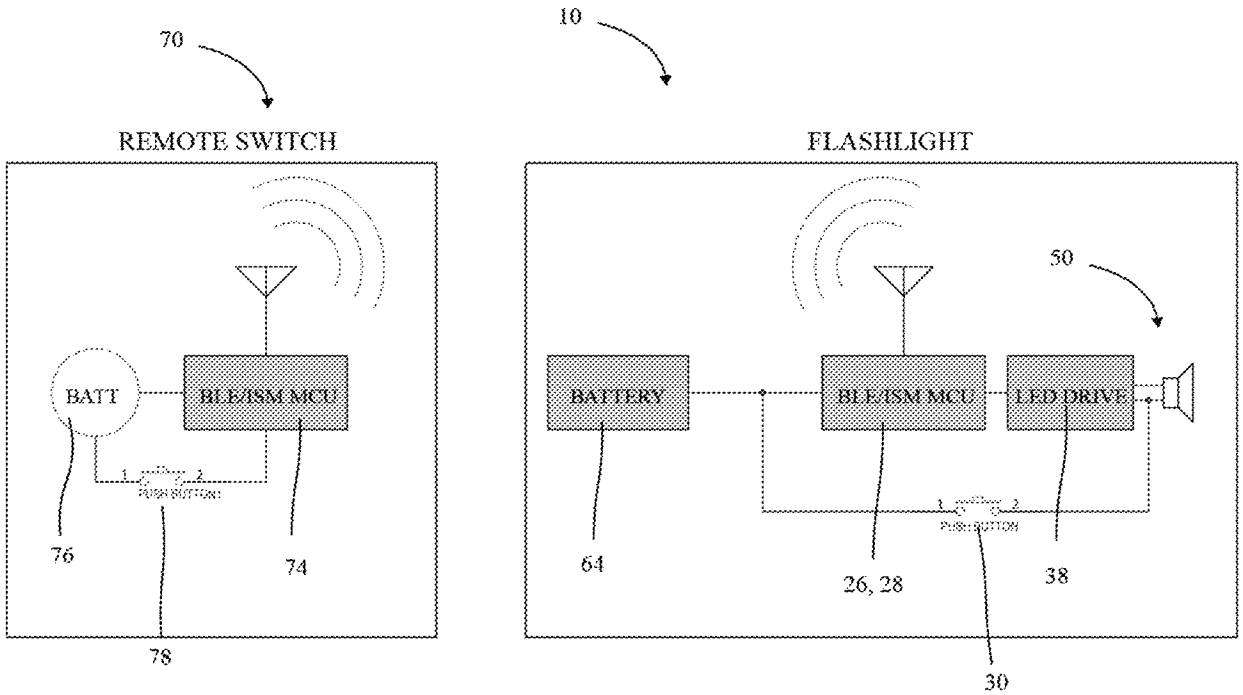
FIG. 18 is another embodiment of an electrical schematic of a wireless light system in accordance to one, or more embodiments.

Referring to FIG. 18, another example electrical schematic showing a wireless light system 10 is provided wherein the components have the same properties and function as previously stated.

Figure 19A:
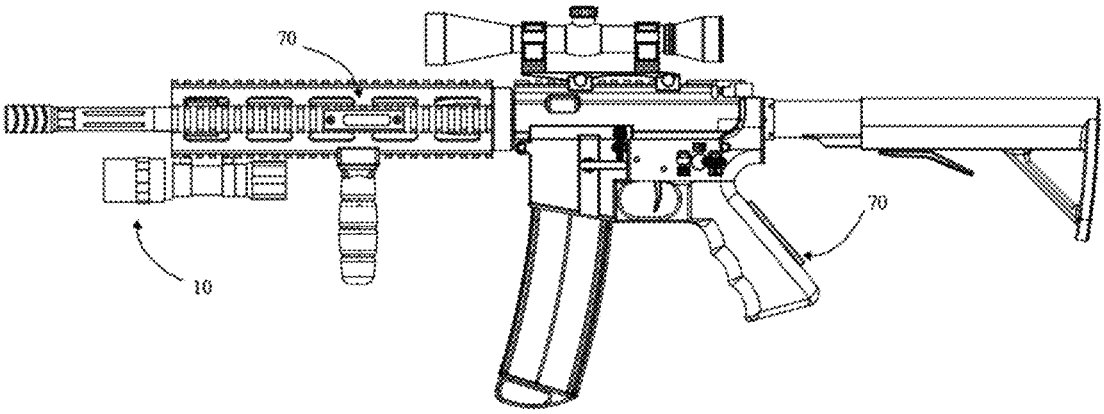
FIG. 19*a* show examples of a remote on a firearm of wireless light system in accordance to one, or more embodiments.
Figure 19B:
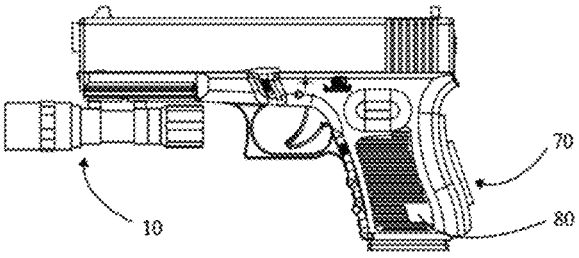
FIG. 19*b* show examples of a remote on a firearm of wireless light system in accordance to one, or more embodiments.
Figure 19C:
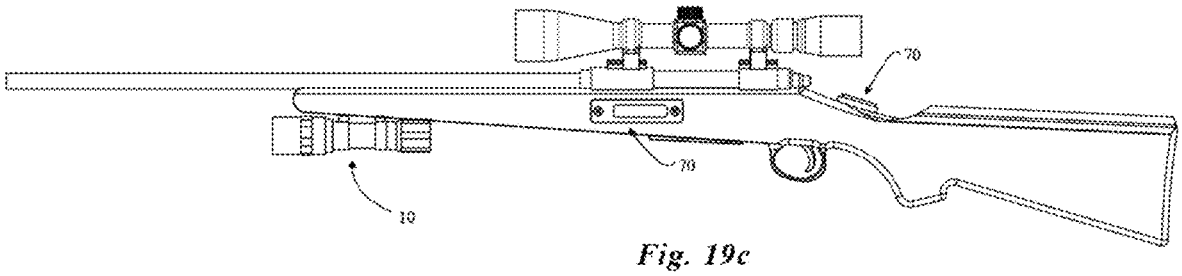
FIG. 19*c* show examples of a remote on a firearm of wireless light system in accordance to one, or more embodiments.

Referring to FIG. 19*a* through 19*c*, examples are shown of the remote 70 and wireless light system 10 mounted on the firearm 100 such as a rifle, assault rifle, or a hand gun wherein the remote can be attached to the firearm through its grip 80 such as, a pistol grip, a handguard, a stock, the backstrap of the frame, a vertical grip, a butt of the rifle, or the like, allowing the user to easily access the remote while holding the firearm. The remote 70 can be placed into the grip wherein the grip can have the remote mounted, molded or machined into the grip as a drop-in replacement or as a replacement grip to the existing firearm's grip. The remote can be a pressure switch, momentary switch, or the like so that when the firearm is held the switch can be activated by the user's hand. The remote 70 can wirelessly send the user's desired settings to the wireless light system 10. The wireless light system 10 can be mounted on the frame near the muzzle on a pistol, forend or handguard of a rifle, shotgun, or assault rifle.

In closing, it is to be understood that although aspects of the present specification are highlighted by referring to specific embodiments, one skilled in the art will readily appreciate that these disclosed embodiments are only illustrative of the principles of the subject matter disclosed herein. Therefore, it should be understood that the disclosed subject matter is in no way limited to a particular methodology, protocol, and/or reagent, etc., described herein. As such, various modifications or changes to or alternative configurations of the disclosed subject matter can be made in accordance with the teachings herein without departing from the spirit of the present specification. Lastly, the terminology used herein is for the purpose of describing particular embodiments only and is not intended to limit the scope of the present disclosure, which is defined solely by the claims. Accordingly, embodiments of the present disclosure are not limited to those precisely as shown and described.

Certain embodiments are described herein, including the best mode known to the inventors for carrying out the methods and devices described herein. Of course, variations on these described embodiments will become apparent to those of ordinary skill in the art upon reading the foregoing description. Accordingly, this disclosure includes all modifications and equivalents of the subject matter recited in the claims appended hereto as permitted by applicable law. Moreover, any combination of the above-described embodiments in all possible variations thereof is encompassed by the disclosure unless otherwise indicated herein or otherwise clearly contradicted by context.

I claim:

1. A remotely mounted light system, comprising:

a light source comprising a light emitter and coupled to a battery having a first end and a second end wherein the battery has a first terminal having a first polarity on the first end and a second terminal having the opposite polarity on the second end;

a manual control switch to selectively activate the light source and a wireless control switch to selectively activate the light source, a third terminal having the opposite polarity of the first terminal, the third terminal essentially located on the first end of the battery and separated from the first terminal by a first insulator;

a first conductor coupled to the first terminal insulated from a second conductor coupled to the third terminal such that the light source and the wireless switch are both powered by a first power source; and a remote comprising a wireless communication transmitter that communicates with the wireless switch and is powered by a second power source.

2. The remotely mounted light system of claim 1, wherein the manual control switch is situated in a tail cap that has a threaded portion that may be coupled to a light housing that has a threaded portion corresponding to the threaded portion of the tail cap.

3. The remotely mounted light system of claim 1, wherein the light source is housed in a light housing that is coupled to a body and wherein the manual control switch is situated in a tail cap, the system further comprising an adapter to attach the tail cap to the body.

4. The remotely mounted light system of claim 1, wherein the light emitter is at least one light emitting diode.

5. The remotely mounted light system of claim 3, wherein the body has a threaded end and wherein the adapter has a threaded portion corresponding to the threaded end of the body to attach the threaded end of the body.

6. The remotely mounted light system of claim 1, wherein the remote is coupled to a handheld device that is removably attached to an accessory.

7. The remotely mounted light system of claim 1, wherein remote is coupled to an accessory wherein the accessory is a firearm, vehicle, helmet, gun grip, or handguard.

8. The remotely mounted light system of claim 3, wherein the tail cap is configured to be used with one of a plurality of adapters, wherein each of the plurality of adapters is sized to correspond to a differently sized body.

9. The remotely mounted light system of claim 1, wherein the first conductor is insulated from the second conductor by air or a substantially non-conductive solid material.

10. The remotely mounted light system of claim 1, wherein the remote is configured to transmit the user's desired light information.

11. The remotely mounted light system of claim 8, wherein the remote is programable and configurable via a portable computing device.

12. The remotely mounted light system of claim 2, wherein the tail cap further comprises a replacement switch that operates in place of the manual switch when the tail cap is coupled to the light source.

13. A wireless light system comprising:

a light housing that houses a source of light, wherein the source of light is powered by a battery having a first end and a second end wherein the battery has a first terminal having a first polarity on the first end and a second terminal having the opposite polarity on the second end;

a body coupled to the light housing;

a tail cap;

a microcontroller powered by the power source and coupled to a wireless communication module and an antenna;

a third terminal having the opposite polarity of the first terminal, the third terminal essentially located on the first end of the battery and separated from the first terminal by a first insulator;

a first conductor coupled to the first terminal and the source of light, the first conductor insulated from a second conductor that is coupled to the third terminal and the microcontroller a remote having a communication interface wherein the communication interface wirelessly communicates user selected light information from the remote to the microcontroller to allow the user to remotely operate the light source.

14. The wireless light system of claim 13, wherein the light housing is coupled to a body, and wherein the tail cap is also coupled to the body and further comprises a power source.

15. The wireless light system of claim 13, wherein the source of light is light emitting diodes.

16. The wireless light system of claim 13, wherein the remote is a handheld computing device.

17. The wireless light system of claim 13, wherein the remote is a switch with at least one button.

18. The wireless light system of claim 13, wherein the remote is programable and configurable via a portable computing device.

19. An accessory for a light system having a light source housed in a light housing, a power source having a first polar terminal on a first end and a second polar terminal having a polarity opposite to the polarity of the first polar terminal on a second end, the power source being coupled to the light source, and the light system having a manual switch to selectively activate the light source, the accessory comprising:

a tail cap that is selectively coupled to the light housing, a flex circuit that couples the second polar terminal to provide a third polar terminal on the first end separated from the first polar terminal by an insulator;

a microcontroller coupled to the tail cap and powered by the power source that can determine the type of light system by identifying at least one of a type of the light source, a power source type, current needed for the light, or a discharge rate of the power source.

20. The accessory of claim 19 wherein the microcontroller can adjust its settings to match the type of flashlight and send to a user's remote at least one of a type of flashlight, a current needed to power the flashlight, a type of light, a type of power source and an estimated time to recommended discharge.

* * * * *